United States Patent [19]

Myers

[11] 4,148,613

[45] Apr. 10, 1979

[54] PROCESS FOR PREPARING SULFUR-CONTAINING COAL OR LIGNITE FOR COMBUSTION

[75] Inventor: Gary A. Myers, Plano, Tex.

[73] Assignee: Atlantic Richfield Company, Los Angeles, Calif.

[21] Appl. No.: 864,353

[22] Filed: Dec. 27, 1977

[51] Int. Cl.[2] ..... C10L 9/10; C10L 9/00

[52] U.S. Cl. ..... 44/1 R; 44/6

[58] Field of Search ..... 44/1 R, 1 G, 4, 6; 201/17

[56] References Cited

U.S. PATENT DOCUMENTS

| | | | |
|---|---|---|---|
| 2,204,148 | 6/1940 | Nelms | 44/4 |
| 3,640,016 | 2/1972 | Lee et al. | 44/1 R |

FOREIGN PATENT DOCUMENTS

| | | | |
|---|---|---|---|
| 168799 | 9/1921 | United Kingdom | 44/4 |

*Primary Examiner*—Carl Dees

*Attorney, Agent, or Firm*—Ronnie D. Wilson

[57] ABSTRACT

An improved process for preparing a coal or lignite fuel that contains sulfur for combustion wherein reduced amounts of sulfur-containing air contaminants are emitted from the combustion. In a process whereby coal or lignite that contains sulfur is pulverized and subsequently mixed with a finely divided inorganic material, the improvement comprises precipitating the inorganic material onto the pulverized coal to achieve greater absorbency of $SO_2$ emissions upon combustion of the coal. The inorganic material can be at least one of the oxide, hydroxide or carbonate of sodium, potassium, calcium or barium; or it can be dolomite.

7 Claims, No Drawings

PROCESS FOR PREPARING SULFUR-CONTAINING COAL OR LIGNITE FOR COMBUSTION

This invention relates to an improved process for preparing a coal or lignite fuel, which contains sulfur, for combustion. In another aspect, this invention relates to an improved process for preparing coal or lignite, which contains sulfur, for combustion wherein the amounts of sulfur-containing air contaminants normally emitted from such combustion are materially reduced.

The burning of petroleum materials, such as oil and natural gas, has for years satisfied the energy needs in this country. Recent economic and political developments have drastically increased the cost of energy sources, such as oil and natural gas. Because of the increased prices of oil and natural gas and because of real and potential shortages of these materials, various alternative sources of energy have been investigated.

It has long been known that vast resources of coal and lignite are available as alternative sources of energy in this country. Thus, a solution to our nation's ever increasing energy requirements is to utilize coal and lignite as a primary energy source. Recently, many utility companies, industrial facilities and the like have either partially or totally changed their energy source to coal or lignite because of their availibility and cost.

Just as interest has shifted from oil and natural gas to alternative sources for energy, there has been an increased emphasis placed on "clean burning" fuels. The term "clean burning" is a term that broadly includes the combustion of various fuels without the production of noxious and harmful combustion products, such as sulfur oxides. In fact, there has been a rash of strict legislative and regulatory restrictions placed on the amount of contaminants, such as sulfur oxides, that can be emitted into the atmosphere. It is, of course, well known in the art that energy sources, such as coal, lignite, and oil, that contain sulfur will produce large quantities of sulfur oxide contaminants.

Unfortunately, much of the coal and lignite found in commercial quantities in this country does contain sulfur in varying quantities. When such sulfur-containing coal and lignite materials are burned, sulfur oxides are produced and are emitted into the atmosphere, unless very costly and elaborate measures are undertaken to remove the sulfur oxides from the flue gases coming from the combustion equipment.

To satisfy the various legislative and regulatory restrictions on the amount of sulfur oxides that may be emitted into the atmosphere by burning sulfur containing coal and lignite, various types of methods and apparatus have been utilized to minimize such emissions. Such methods and apparatus have added to the cost of the conversion of the sulfur containing coal or lignite into useful energy. In order to meet rigid requirements pertaining to emissions of sulfur oxides, the cost of various methods and apparatus for reducing sulfur oxide emissions, such as by use of complicated and costly scrubbers and precipitators, has virtually made some coal and lignite supplies commercially unattractive for the production of needed energy.

Therefore, it is desirable that inexpensive and practical methods be developed for converting sulfur-containing coal and lignite into useful energy with reduced emissions of sulfur-containing air contaminants.

Accordingly, it is an object of this invention to provide an improved process for preparing a sulfur-containing coal or lignite material for combustion. It is another object of this invention to provide an improved process for preparing sulfur-containing coal or lignite for combustion in conventional equipment with reduced sulfur oxide emissions.

Other aspects, objects and advantages of this invention will be apparent to those skilled in the art from the following disclosure and appended claims.

In accordance with the present invention, sulfur-containing coal or lignite is pulverized and admixed with an inorganic material which includes the steps of mixing the pulverized coal or lignite with a solution containing the chloride or nitrate of the inorganic material and subsequently contacting the admixture with $CO_2$, $NH_4OH$, $(NH_4)_2CO_3$, KOH, and/or NaOH in order to precipitate the oxide or hydroxide respectively of the inorganic material on and in the pores of the coal or lignite. The resulting admixture of coal or lignite and the inorganic material can thereafter be subjected to a combustion process in conventonal combustion equipment with reduced emissions of sulfur oxide products. The resulting admixture can be formed into pellets, briquettes, or other large particles for subsequent shipping, storage and/or combustion in conventional equipment. The inorganic material that is precipitated on the pulverized sulfur-containing coal or lignite can be at least one material selected from: an oxide of sodium, potassium, calcium or barium; a hydroxide of sodium, potassium, calcium or barium; a carbonate of sodium, potassium, calcium or barium; or dolomite.

In the practice of the present invention, sulfur-containing coal or lignite is reduced in size to form a finely divided material. A solution containing the chloride or nitrate of sodium, potassium, calcium, barium or dolomite is mixed with the finely divided coal or lignite. Subsequently, the resulting mixture is contacted under a vacuum with $CO_2$, $NH_4OH$, $(NH_4)_2CO_3$, KOH, and/or NaOH to precipitate onto and into the pores of the finely divided material the oxide or hydroxide respectively of sodium, potassium, calcium, barium or dolomite.

In one embodiment of this invention, a sulfur containing coal or lignite material is reduced in size to form a finely divided coal or lignite. The fine coal or lignite is then deeply cleaned by known methods in the art. By deeply cleaning the fine coal or lignite the majority of ash and pyritic sulfur is removed therefrom. It has been found that the best results in reducing the amount of sulfur dioxide that is emitted upon burning sulfur-containing coal or lignite are obtained when the coal or lignite is finely divided, cleaned, and the inorganic material is then precipitated under a vacuum on the fine coal or lignite material. While some reduction in the amount of sulfur dioxide will be achieved by precipitating the specific inorganic materials on the coal or lignite when the coal or lignite has a relatively large particle size, it is desirable to reduce the particle size of the coal or lignite prior to the combustion process and to precipitate the inorganic material on the small particle size coal or lignite. Of course, it will be realized that most coal or lignite is mined with mechanical equipment; and it is often recovered from the mine site in large, irregular particle sizes. Thus, in a preferred embodiment of this invention, it is desirable to reduce the particle size of the coal or lignite to as small a particle size as is practical. As the particle size of the coal or lignite decreases, the efficiency of the instant invention in reducing the emissions of sulfur dioxide increases, at a given level of the inorganic materials. There is no minimum size restriction placed on the particle size of the coal or lignite to be contacted by the precipitated inorganic material to form the mixture for later burning. Preferably, however, the particle size of the coal or lignite will be less than about one-tenth inch in diameter in order to achieve the desired reductions in sulfur dioxide emissions when the coal or lignite is burned. More preferably, the coal or lignite will have a particle size in the 48 mesh range or smaller (Tyler screen mesh sizes).

Any known method and equipment for reducing the size of the coal or lignite can be utilized, such as conventional grinding and crushing in crushers, hammer mills and the like. As used throughout this specification, the term "pulverized" coal or lignite shall mean coal or lignite that has an average particle size of less than about one-tenth inch in diameter.

The inorganic material that is precipitated on the pulverized coal or lignite can be at least one material selected from the oxides of sodium, potassium, calcium or barium; the hydroxides of sodium, potassium, calcium or barium; the carbonates of sodium, potassium, calcium or barium; and dolomite. Thus, suitable examples of inorganic materials that can be precipitated on the pulverized sulfur containing coal or lignite include sodium oxide, potassium oxide, calcium oxide, barium oxide, sodium hydroxide, potassium hydroxide, calcium hydroxide, barium hydroxide, sodium carbonate, potassium carbonate, sodium bicarbonate, calcium bicarbonate, calcium carbonate, barium carbonate and dolomite ($CaMg(CO_3)_2$). Also, mixtures of the foregoing materials can be used as the inorganic material that is precipitated onto the sulfur-containing coal or lignite. Solutions containing $Ca(NO_3)_2$ and/or $Ca(Cl)_2$ are examples of suitable solutions that when contacted under a vacuum with $CO_2$, $NH_4OH$, $(NH_4)_2CO_3$, KOH, and/or NaOH will precipitate inorganic materials, such as $CaCO_3$ and/or $Ca(OH)_2$, onto and into the pores of the finely divided coal or lignite.

Subsequent to precipitation of the inorganic materials onto the fine coal or lignite, the fine coal or lignite will be separated from the solution and dried. After drying, problems may be experienced in the handling, shipping, storage and burning of the admixture of finely divided coal or lignite and the inorganic material. The finely divided solids are prone to blow and be dispersed in even slight air currents. There is also a danger of explosions when finely divided coal or lignite is handled, stored or shipped. Admixtures of finely divided coal or lignite and the inorganic materials may also tend to separate due to differing densities when they are handled, shipped or stored, especially under conditions where such admixtures are subjected to vibrations. Therefore, the admixture may be formed into pellets, briquettes or other larger particles to allow the admixture to be safely and efficiently handled, shipped, stored and used in conventional equipment. The admixture of inorganic material with the coal or lignite can be agglomerated or pelletized to produce a product which can be safely handled, shipped, or stored without appreciable dust loss and can be supplied to conventional combustion apparatus with conventional equipment normally used for handling and stoking coal or lignite in large pieces.

Any suitable method for forming the pellets, briquettes or larger pieces of the admixture can be utilized. In forming the pellets, briquettes and other larger pieces, it is particularly desirable to utilize binders or adhesives, such as small amounts of coal tar pitch, petroleum pitch and residue materials, such as vacuum residium, or other adhesive material, such as lignin sulphates, that are obtained as byproducts in the paper industry. By mixing or coating the small finely divided particles of coal or lignite and inorganic material with a suitable adhesive material, such as those mentioned above and thereafter, submitting the mixture to an agglomerating, prilling, or a compressing process, larger particles, prills, pellets or briquettes can be formed. Such larger discrete particles, prills, pellets, and briquettes can be shipped, handled, stored and used without the disadvantages normally associated with powdered or pulverized coal or lignite. By utilizing the technique of forming the safe and convenient pellets, briquettes or larger pieces of the admixture, the sulfur-containing coal or lignite can be burned in conventional combustion equipment, such as stoker type furnaces, with greatly reduced emissions of sulfur contaminants.

The amount of inorganic material that will be precipitated onto and admixed with the pulverized coal or lignite will depend on the amount of sulfur that is contained in the raw coal or lignite. Normally, the inorganic material will be added to the coal or lignite in an amount such that at least a stoichiometric amount of the inorganic material is present with respect to the amount of sulfur in the coal or lignite. The stoichiometric amounts of the inorganic materials are calculated on the basis of two-pound atoms of the sodium or potassium compounds per one-pound atom of sulfur contained within the coal or lignite and one-pound atom of the barium or calcium compounds, including dolomite, per pound atom of the sulfur contained in the coal or lignite. Expressed in another way, the inorganic materials will be added to the sulfur containing coal or lignite in such amounts as to provide an atomic ratio of sodium or potassium to sulfur of at least 2:1 and an atomic ratio of calcium or barium to sulfur of at least 1:1. Thus, in the preferred embodiment of this invention, the calcium to sulfur atomic ratio should be at least about 1:1; the barium to sulfur atomic ratio should be at least about 1:1; the potassium to sulfur atomic ratio should be at least about 2:1; and the sodium to sulfur atomic ratio should be at least about 2:1. While there will be some reduction in the amount of sulfur-containing contaminants that are emitted from the combustion chamber when the inorganic materials are added in quantities less than those stated above, the optimum sulfur reduction will be obtained when the above-mentioned mol ratios are at least those as stated.

Since the inorganic materials that are precipitated onto the sulfur-containing coal or lignite are, in fact, ash forming materials, it will be appreciated that it is undesirable to add large excesses of the inorganic materials. From a practical standpoint, the inorganic materials will be added in amounts such that the final admixture will have an atomic ratio of calcium to sulfur or barium to sulfur of from about 1:1 to about 5:1 and an atomic ratio of potassium to sulfur or sodium to sulfur of from about 2:1 to about 10:1 to achieve significant reductions in the amount of sulfur-containing emissions upon combustion, yet to minimize the amount of undesirable ash formed upon combustion of the coal or lignite. Since most coal and lignite will contain less than five weight percent sulfur, it will be appreciated that the final admixture of the sulfur or lignite with the inorganic material will not contain great amounts of the inorganic ash forming material.

The following example is presented to illustrate embodiments of the present invention. The example is given for illustrative purposes only and are not intended to limit the scope of the invention.

EXAMPLE

A series of runs are carried out to show the effectiveness of precipitating calcium hydroxide on coal in reducing the emissions of sulfur-containing contaminants from a combustion zone wherein a sulfur-containing coal is burned. In the series of runs, Illinois No. 6 coal is ground to a particle size of less than sixty mesh. In each run from about four to five grams of coal are weighed and placed in a ceramic boat and then placed in a 1 inch diameter combustion tube. The combustion tube is heated in an electric furnace at 1600° F. Air is passed across the ceramic boat in the combustion tube, and the combustion gases are bubbled through a scrubber containing a 5 percent solution of sodium hydroxide. Following complete combustion of the coal sample, the scrubber solution is analyzed for sulphates by first neutralizing the solution and adding barium chloride. The barium sulphate, resulting from the amount of sulfur absorbed from the combustion gases is analyzed to determine the amount of sulfur that is absorbed in the scrubber solution. The barium sulphate is determined by a light scattering technique. In the first run, only Illinois No. 6 coal is burned. In run 2 calcium hydroxide is ground to a particle size of less than sixty mesh and blended with the coal prior to the combustion to produce an intimate admixture. In run 3 the ground coal is placed in a container and a vacuum is drawn. A solution containing 500 grams of Ca $(NO_3)_2$ in 1000 grams of $H_2O$ is introduced into the container. A solution of concentrated NaOH is added to the container precipitating $Ca(OH)_2$ on the coal particles. The results of the tests are reported below in Table I:

TABLE I

| Run | Combustion Sample (WT. %) | Sulfur Collected in Scrubber as a Weight % of Feed Coal |
|---|---|---|
| 1 | 100% coal | 2.35 |
| 2 | 80% coal and 20% $Ca(OH)_2$ | 0.0005 |
| 3 | 80% coal and 20% ppt. $Ca(OH)_2$ | 0.0001 |

The foregoing example illustrates the improvement of precipitated calcium hydroxide over blended $Ca(OH)_2$ for reducing the emissions of sulfur containing contaminants when the sulfur-containing coal is burned. It should be noted that when only the raw coal is burned virtually all of the sulfur contained in the original coal sample is emitted as a sulfur-containing contaminant in the flue gas. When 20 weight percent of calcium hydroxide is blended with the coal, about 0.02% of the sulfur in the coal sample is emitted as a sulfur-containing contaminant, as shown in run 2. When 20 weight percent calcium hydroxide is precipitated on the coal, about 0.004% of the sulfur in the coal sample is emitted as a sulfur-containing contaminant.

Various changes and modifications may be made in the foregoing disclosure without departing from the spirit and scope of this invention.

I claim:

1. In a method of treating sulfur-containing coal or lignite to reduce $SO_2$ emissions during combustion thereof via admixing pulverized sulfur containing coal or lignite with an inorganic material selected from the group consisting of an oxide, hydroxide or carbonate of sodium, potassium, calcium or barium and dolomite in order to increase the $SO_2$ absorbency of said treated coal or lignite, the improvement comprises:

mixing said pulverized coal or lignite with a solution containing the chloride or nitrate of said inorganic material and subsequently contacting said mixture with a precipitating agent selected from the group consisting of $CO_2$, $NH_4OH$, $(NH_4)_2CO_3$, KOH, and NaOH thereby precipitating the oxide or hydroxide respectively of said inorganic material on said coal or lignite.

2. The improvement of claim 1 wherein said pulverized coal or lignite is deeply cleaned prior to mixing with said chloride or nitrate containing solution.

3. The improvement of claim 1 wherein said chloride containing solution is $CaCl_2$.

4. The improvement of claim 1 wherein said nitrate containing solution is $Ca(NO_3)_2$.

5. The improvement of claim 3 wherein said precipitate is $CaCO_3$.

6. The improvement of claim 5 wherein said precipitate is $Ca(OH)_2$.

7. The improvement of claim 1 wherein said contact with said precipitating agent takes place under vacuum conditions.

* * * * *